US007864111B2

(12) United States Patent
Stoyanov

(10) Patent No.: US 7,864,111 B2
(45) Date of Patent: Jan. 4, 2011

(54) ARRANGEMENT FOR STEERING RADIATION LOBE OF ANTENNA

(75) Inventor: Vladimir Stoyanov, Oulu (FI)

(73) Assignee: Powerwave Comtek Oy, Kempele (FI)

( * ) Notice: Subject to any disclaimer, the term of this patent is extended or adjusted under 35 U.S.C. 154(b) by 0 days.

(21) Appl. No.: 11/946,600

(22) Filed: Nov. 28, 2007

(65) Prior Publication Data

US 2008/0070507 A1 Mar. 20, 2008

Related U.S. Application Data

(63) Continuation of application No. PCT/FI2006/050199, filed on May 18, 2006.

(30) Foreign Application Priority Data

Jun. 3, 2005 (FI) ..... 20055285

(51) Int. Cl.
*H01Q 3/28* (2006.01)

(52) U.S. Cl. ..... 342/375

(58) Field of Classification Search ..... 342/375; 333/159, 161

See application file for complete search history.

(56) References Cited

U.S. PATENT DOCUMENTS

| | | | | |
|---|---|---|---|---|
| 3,423,699 | A | 1/1969 | Hines | |
| 4,451,831 | A | 5/1984 | Stangel et al. | |
| 4,489,324 | A | 12/1984 | Blume | |
| 4,717,918 | A | 1/1988 | Finken | |
| 4,751,453 | A * | 6/1988 | Foti | 323/212 |
| 4,859,972 | A | 8/1989 | Franke et al. | |
| 5,128,639 | A | 7/1992 | Ueda et al. | |
| 5,798,675 | A * | 8/1998 | Drach | 333/161 |
| 6,097,267 | A | 8/2000 | Hampel | |
| 6,333,683 | B1 | 12/2001 | Hampel | |
| 6,850,130 | B1 * | 2/2005 | Gottl et al. | 333/161 |
| 7,388,556 | B2 * | 6/2008 | Zimmerman | 343/833 |

FOREIGN PATENT DOCUMENTS

| | | |
|---|---|---|
| GB | 2384369 A * | 7/2003 |
| JP | 61127203 | 6/1986 |
| JP | 6196927 | 7/1994 |
| JP | 6326502 | 11/1994 |
| JP | 7321536 | 12/1995 |
| JP | 2003124703 | 4/2003 |
| SU | 1513548 | 10/1989 |
| WO | 98/21779 | 5/1998 |
| WO | 01/13459 | 2/2001 |

* cited by examiner

*Primary Examiner*—Gregory C Issing
(74) *Attorney, Agent, or Firm*—OC Patent Law Group

(57) ABSTRACT

An arrangement for electronically steering a radiation lobe of an antenna. Radiators of the antenna are located in a row and two radiators, which are equidistant from a midpoint of the row, form a radiator pair. To steer the radiation lobe, each pair is associated with a reflection-type phase shifter, implemented by a shared transmission line and reflection point, which can be moved. Phase changes take place by moving the reflection point along the transmission line using one movable or several fixed reflection circuits. The phase adjusting for all radiator pairs in a row is implemented simultaneously by a common control circuit. In the former case the reflection circuits of the different transmission lines are slides attached to one and the same movable arm. In the latter case one of the reflection circuits of each transmission line is activated at a time.

13 Claims, 7 Drawing Sheets

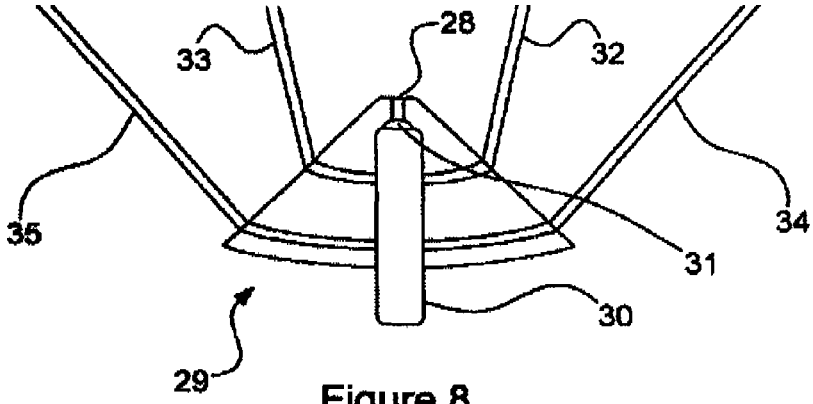
Figure 8
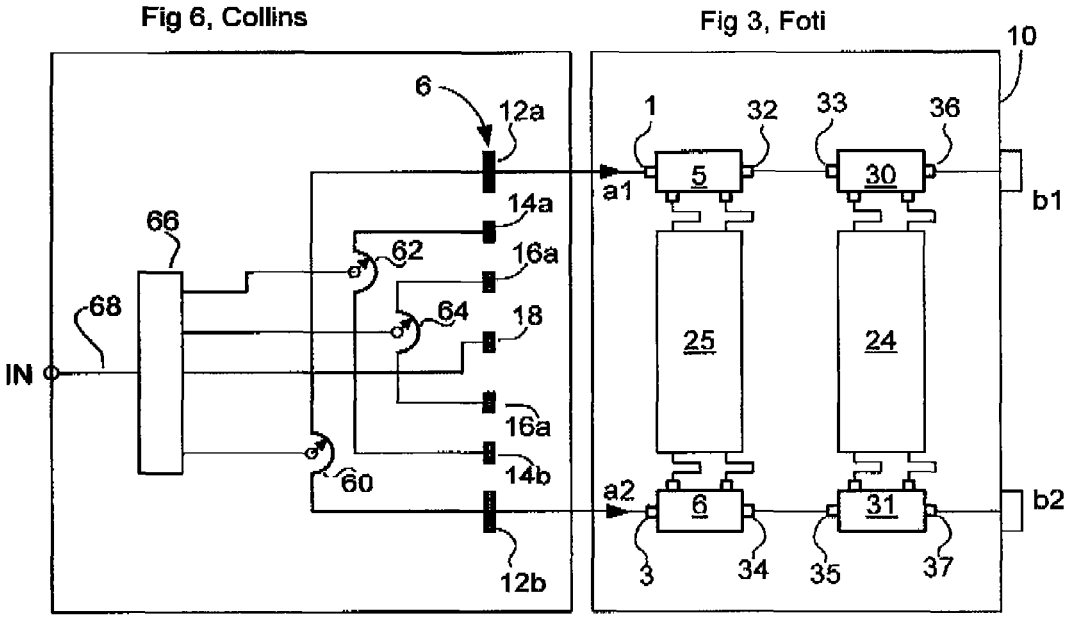

ARRANGEMENT FOR STEERING RADIATION LOBE OF ANTENNA

CROSS REFERENCE TO PRIOR APPLICATIONS

This application is a continuation of International Application No. PCT/FI2006/050199 filed May 18, 2006, which claims priority from Finnish Patent Application No. 20055285 filed Jun. 3, 2005. The entire contents of both applications are incorporated by reference in their entireties.

The invention relates to steering a radiation lobe of an array antenna without turning the antenna itself. The steering arrangement is aimed for the base station antennas in mobile communication networks and for vertical adjusting of the transmitting direction, in particular.

BACKGROUND OF THE INVENTION

The traffic capacity of radio networks is increased by dividing a geographic area to so-called cells and by using the same carrier frequencies simultaneously in different cells, as known. The capacity of a network is the higher the smaller the cells are and the closer to each other the cells are in which the same carrier frequencies can be used. Instead of an omnidirectional antenna, a plurality of antennas radiating controllably in different sectors are often used in the base stations of the cells. In that case the base stations at a certain distance from each other, using the same carrier frequency, interfere less with the transmitted signals of each other. This means that the reuse distance of frequencies can be reduced and the capacity of the network thus further increased.

Both the transmitting power and the direction of the transmitting in the vertical plane of an antenna radiating in a certain sector have to be chosen so that the coverage area is sufficient, but on the other hand the interfering influence in the neighboring cell is slight enough. The angle between the middle direction of the transmitting main lobe and the horizontal direction is called "tilt angle". If no changes were to happen in the circumstances, the tilt angle would be constant without adjusting possibility. However, in practice the traffic intensity in the cells fluctuates a great deal. During minor traffic it is advantageous to keep the tilt angle smaller than during heavy traffic, because in that case the connection quality in the border regions of the cells becomes better without the total interference remarkably growing in the neighboring cells. In addition, the shape of the built environment in the cell can change so much that there is reason to change the tilt angle.

Changing the direction of the antenna radiation lobe, without turning the antenna mechanically, succeeds when an array of radiators is applied. When the phases of the carriers fed to the radiators in a row are arranged to have suitably different values, the lobe turns off into the desired direction from the normal of that row, as known. Changing the tilt angle then requires adjustable phase shifters in the feed paths of the radiators and that the radiators are located in a substantially vertical row. The radiator row can deviate from the vertical direction as much as a typical tilt angle is achieved without any phase shifts. After that the tilt angle can be changed upwards and downwards by means of phase shifts.

The phase shifts needed in the feed of an adjustable antenna are so great at the maximum that in practice only transmission line type solutions come into question as phase shifters. The physical length or at least the electric length of a transmission line has to be changeable by electric control. A wholly electric adjustable phase shifter is obtained, when the length of the transmission line is changed e.g. by means of diode switches or ferrite pieces being located in the space where the field propagates in the transmission line. In the latter case the permeability of the ferrite and thus the effective phase coefficient of the whole transmission line is changed. A disadvantage of these kinds of electric solutions is the losses caused by them, and in the case of diodes also the non-linearity. They are also expensive, if the phase shifters are made satisfactory for transmitting use by power capacity. Therefore the phase shifters used in the transmitters of base stations are in practice electromechanical so that they include a structural part movable by an actuator, the location of which part determines the (electric) length of the transmission line. In this description and claims such a structural part, movable along a line, is called "slide".

A simple electromechanical phase shifter has a straight transmission line and a slide, by which a tapping is formed in the line. A radio frequency signal is fed to the line end and is taken out from the tapping. When e.g. a 225-degree phase shift is needed, the distance between the line end and the slide is adjusted to have value $0.625\lambda$. $\lambda$ is the wavelength in the line and it depends on the dielectricity and permeability of the medium between the line conductors. The length of the transmission line has to correspond directly to the greatest phase shift needed, of course. The length of the transmission line and thus the space required for the circuitry is reduced, when a reflection in the transmission line is utilized. In this case a short-circuit, and not a tapping, is formed in the transmission line by means of a movable slide. A signal, or electromagnetic field, arriving to the short point reflects to the reverse direction, as known. When the signal has arrived back to the starting end, it has traveled a double distance, for which reason also the phase shift is double compared to the structure, where the signal is taken out from the tapping being located at the same distance. For obtaining a certain maximum phase shift, a line having half length is then sufficient. That kind of shorted transmission line requires a separating element as an additional structure, which element separates the reflected signal, being in the same line with the incoming signal, to a transmission path of its own for feeding to the antenna. A circulator, for example, is suitable as such a separating element. A shorted line together with a circulator forms a phase shifter. More generally, in this description and claims a phase shifter using signal reflection includes also a separating element.

In this description and patent claims the term "reflection line" means a transmission line having in its tail end a circuit, which causes a reflection, so that a signal fed to the starting end comes also out from the starting end.

Using two parallel reflection lines and a four-port hybrid as a separating element instead of one reflection line and a circulator, a higher power capacity and better linearity are achieved. FIG. 1 shows an example of this kind of phase shifter suitable for the antenna feed circuit, known from the publication U.S. Pat. No. 6,333,683. The structure comprises a first reflection line 141, a second reflection line 142 and a hybrid 150, which has four ports P1-P4. The input line 101 of the structure is connected to the first port P1, and the output line 102 is connected to the fourth port P4. The first reflection line in turn is connected to the second port P2, and the second reflection line is connected to the third port P3. A radio frequency signal fed to the first port can propagate through the second and third ports to both reflection lines; there is 90-degree phase difference between those two partial signals. The reflected signal arriving to the second port from the first reflection line and the reflected signal arriving to the third port from the second reflection line have the same 90-degree phase difference, because the reflection lines are equal in length.

Arriving to the first port of the hybrid, the reflected partial signals have opposite phases, and arriving to the fourth port they have the same phase. The reflected signal then can propagate only to the output line 102 through the fourth port P4. The input line, output line and reflection lines are all similar by structure. The cross section of the line structure as magnified is seen in the upper supplementary drawing in FIG. 1. Each line comprises two strip-like ground conductors GND one on top of the other and one narrower centre conductor CEC between the ground conductors. The medium is mostly air.

The reflection lines are located parallelly, and crosswise between them there is a shared dielectric slide 130. One end of the slide implements the short-circuit in the first reflection line 141 and the opposite end implements the short-circuit in the second reflection line 142. The slide fills in its location almost wholly the space between the ground conductors in both lines. For the centre conductor of each line the slide has a flat hole in the direction of the line. As can be seen, the short-circuit is not galvanic. The dielectric medium only enhances the capacitance between the centre conductor and ground conductors in the location of the slide so much that there prevails almost a short-circuit in the operating frequencies of the antenna.

Because of the structure described above the reflection lines become as much longer or shorter, when the slide 130 is moved. They are always equal in length, in which case the phase shifts always are equal in them. This is necessary in order to get the partial signals with the same phase to the fourth port of the hybrid 150 for summing and feeding to the antenna.

In FIG. 2 there is an example, known from the publication WO98/21779, on how to arrange the phase differences for the radiators of a group antenna to steer the radiating lobe. The antenna comprises three radiators, which are located in the same mast at different altitudes. The radio frequency signal IN coming from the power amplifier of the transmitter is divided into two parts by the divider 210. One part is led directly to the middle radiator. The other part is led to the phase shifter 200 and through it half and half to the uppermost radiator and to the lowest radiator. The phase shift structure differs from the structure according to FIG. 1. Its transmission line 220 has the shape of a circle arc, and the slide 230 is moved by a rotational motion. For this purpose the slide is located at the end of an arm 215, which has been provided with an axis to its opposite end. At the same time the arm functions as a feed line of the transmission line 220. The axis is rotated by an electric motor. The first end of the transmission line, or the first output of the phase shifter, is connected to said uppermost radiator, and the second end, or the second output of the phase shifter, is connected to said lowest radiator. When the slide is in its middle position, the signals of all three radiators are in the same phase, in which case the antenna main lobe is perpendicular to the straight line drawn along the radiators. When the slide 230 is located closer to the first end of the transmission line 220 than to its second end, the phase of the uppermost radiator leads the phase of the middle radiator, and the phase of the lowest radiator lags the phase of the middle radiator. In this case the antenna main lobe has been turned downwards from the above-mentioned perpendicular position. Correspondingly, when the slide is located closer to the second end of the transmission line than to its first end, the antenna main lobe has been turned upwards from the said perpendicular position.

The phase shifter according to FIG. 2 can be called differential, because moving the slide changes the phases of the two output signals equally, but to opposite directions. As appears from the description above, the reflection is not used in this phase shifter.

From the publication WO01/13459 is known an arrangement comprising more than one similar differential phase shifters as in the previous example. The transmission lines of the phase shifters have the same midpoint of the curvature, and their slides are moved by a common rotatable arm, which functions as an input line, at the same time.

SUMMARY OF THE INVENTION

An object of the invention is to implement the steering of the antenna radiating lobe in a new and advantageous way compared with the prior art. The arrangement according to the invention is characterized in that which is specified in the independent claim 1. Some advantageous embodiments of the invention are specified in the dependent claims.

The basic idea of the invention is as follows: The radiators of an array antenna are arranged in at least one row. Two radiators of a row, which are located equidistant from the middle point of that row, form a radiator pair. To steer the radiation lobe, the phase of the signal of the first radiator in the pair is e.g. advanced and the phase of the signal of the second radiator in the pair is lagged by equivalent amount. For this aim each radiator is fed through a phase shifter comprising at least one reflection line and a separating element. A reflection line for the first radiator and a reflection line for the second radiator are implemented by a transmission line, which is shared between these radiators. The radio frequency signal to be led to the first radiator is fed to the first end of this transmission line, and the signal to be led to the second radiator is fed to the second, opposite end of the same transmission line. In the transmission line there is a reflection point, the place of which can be moved. One reflection line is located from the reflection point to a direction of the transmission line and the other reflection line is located from the reflection point to the opposite direction of the transmission line. The above-mentioned phase changes take place by moving the reflection point along the transmission line. For moving the reflection point the transmission line has one movable or several fixed reflection circuits. In the former case the reflection circuits of the different transmission lines are slides attached to one and the same movable arm. In the latter case one of the reflection circuits of each transmission line is activated at a time. If the number of the radiator pairs is more than one, the phase adjusting for the all radiator pairs is implemented simultaneously by the common control. The greater the distance of the radiators of a radiator pair from the middle of the row, the more the phase of their signals is changed.

An advantage of the invention is that the phase shift structure is relatively space-saving. This is due to that the phase shifters are of reflection type, and on the other hand that each phase shifter pair functions differentially. Without the latter characteristics separate transmission lines would be needed for both radiators of a radiator pair, which transmission lines would have the same length as the shared transmission line according to the invention. Another advantage of the invention is that the structure according to it is simple, which results in high reliability and relatively low production costs. One factor for the simplicity is that it is not necessary to feed the signals through the moving part of the phase shifter.

BRIEF DESCRIPTION OF THE DRAWINGS

The invention is described in detail below. The description refers to the enclosed drawings, in which

FIG. 8 presents a fourth example of an arrangement according to the invention for steering the antenna radiating lobe;

DETAILED DESCRIPTION OF THE INVENTION

Figure 1:
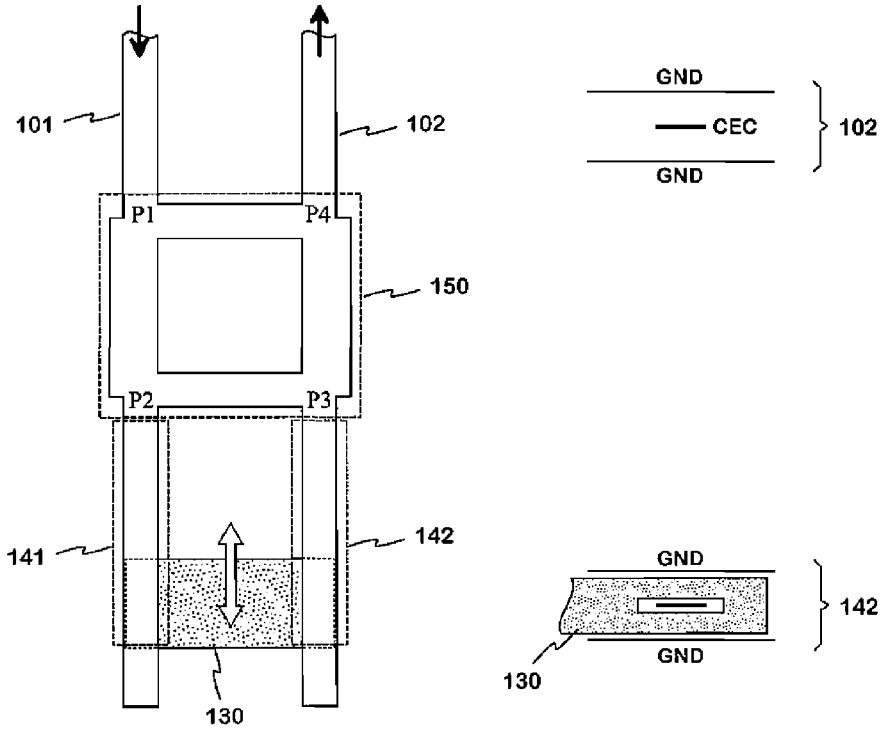
Fig. 1 PRIOR ART
FIG. 1 presents an example of a known phase shifter, suitable for the antenna feed circuit.
Figure 2:
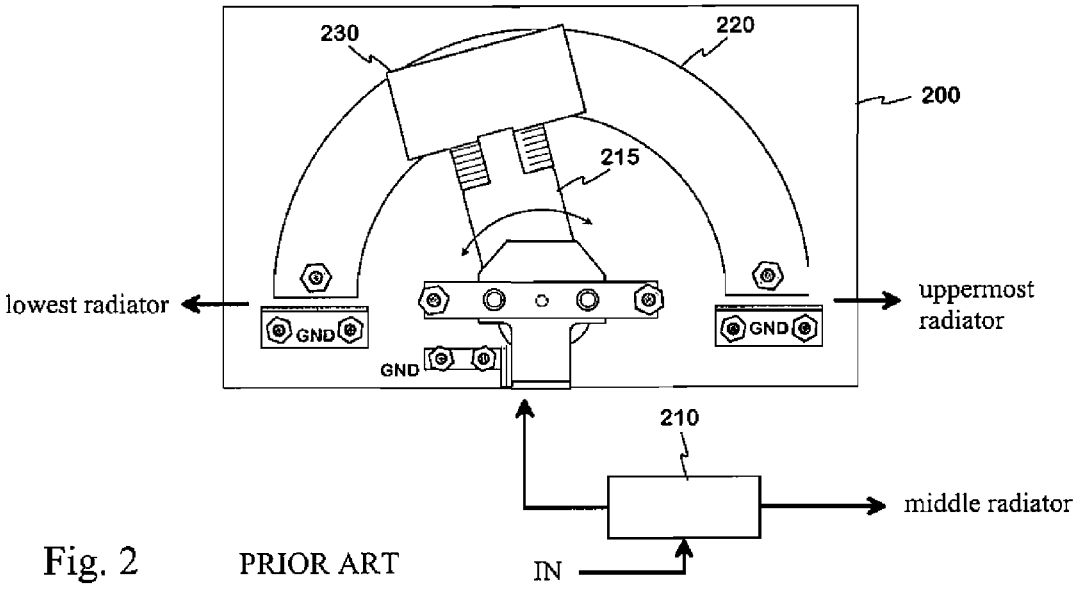
Fig. 2 PRIOR ART
FIG. 2 presents another example of a known phase shift arrangement in the antenna feed circuit for steering the antenna radiating lobe.

FIGS. 1 and 2 were described already in connection with the description of prior art.

Figure 3A:
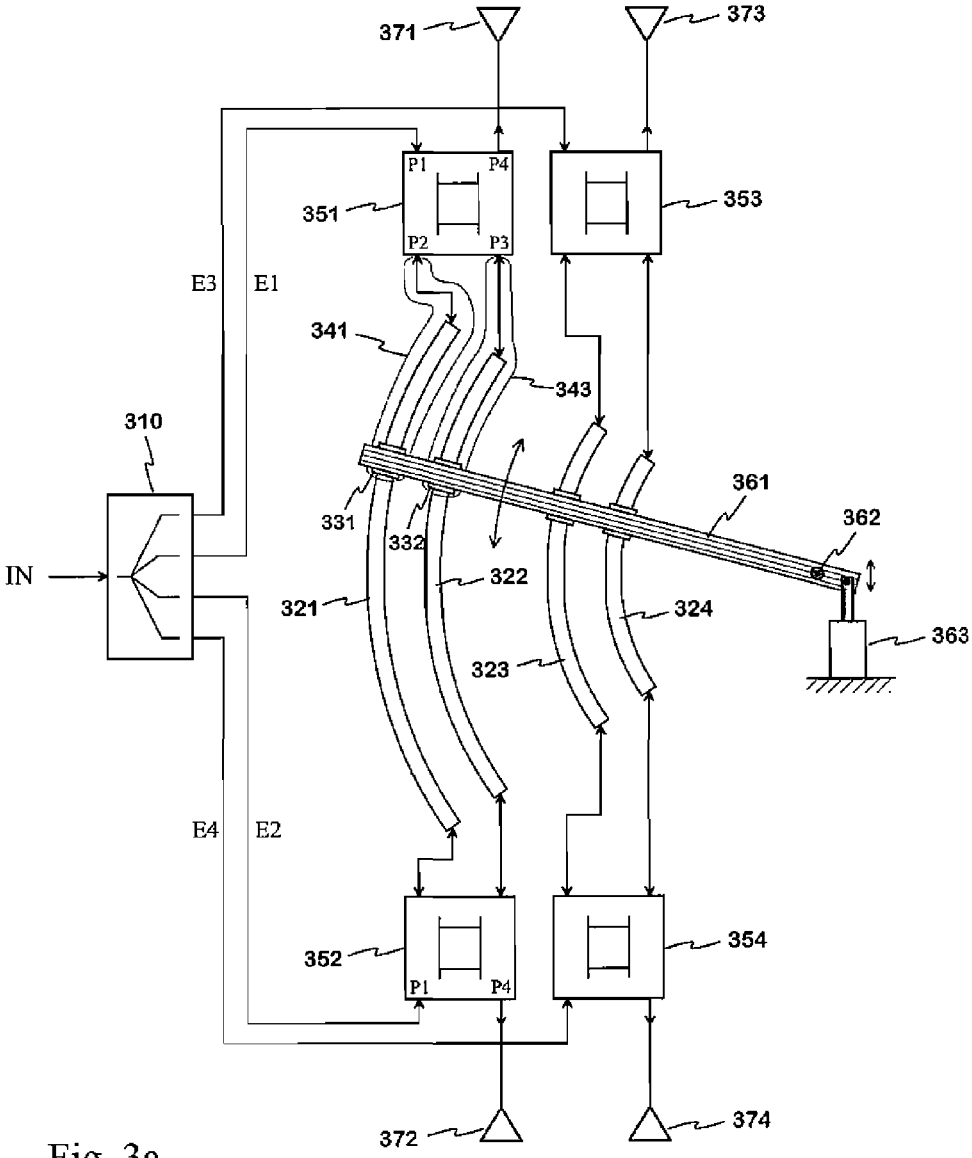
FIG. 3*a* presents an example of an arrangement according to the invention for steering the antenna radiating lobe.
Figure 3B:
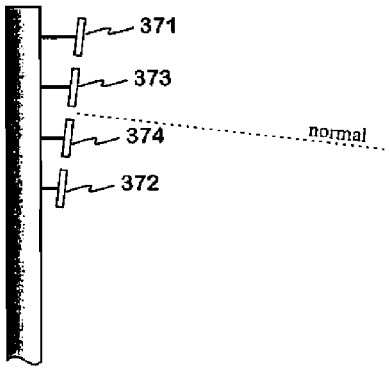
FIG. 3*b* presents an example of location of the radiators of FIG. 3*a;*

FIG. 3*a* shows an example of an arrangement according to the invention, for steering the radiating lobe of an array antenna. The array antenna comprises in this example four radiators, which are located in a row according to the example of FIG. 3*b*: The first 371 and second 372 radiators are the outermost radiators in the row, and the third 373 and fourth 374 radiators are the inner radiators in the row. The aim is to arrange the phase of the radiator signals to be varied linearly as a function of the location of the radiators, whereupon the radiation lobe turns from the normal of the radiator row, remaining in its shape. In this case the variation is implemented so that, regarding both the pair formed of the outermost radiators and the pair formed of the inner radiators, the phase of one radiator signal is advanced equivalent as the phase of the other radiator signal is lagged. The phase change for the inner radiator pair is aimed to be smaller than the phase change for the outermost radiator pair. More generally, if the number of the radiators in the row is arbitrary, two radiators, which are located equidistant from the midpoint of the row, form a pair, which is treated in the above-described way.

The arrangement comprises a power divider 310 and one reflection-type phase shifter for each radiator. The divider can be e.g. a 4-way Wilkinson divider or it can include first a 2-way divider and then two 2-way dividers as well, connected to the outputs of the first divider. Each phase shifter is functionally similar to the phase shifter in FIG. 1: it comprises a hybrid and two adjustable reflection lines. Each hybrid has a first port P1, a second port P2, a third port P3 and a fourth port P4, the first port being the input port and the fourth port being the output port, as in FIG. 1. The first phase shifter comprises the first hybrid 351, the first reflection line 341 and the third reflection line 343, and the second phase shifter comprises the second hybrid 352, the second reflection line and the fourth reflection line. The first and second reflection line, their reflection circuits excluded, form a unitary first transmission line 321, and correspondingly the third and fourth reflection line, their reflection circuits excluded, form a unitary second transmission line 322. The first and second transmission lines travel side by side, are arched and have the same shared curvature midpoint. The reflection circuits are short-circuits by nature, and are implemented by slides. The first transmission line 321 has a first slide 331, which is a movable short-circuit piece shared between the first and second reflection line. Correspondingly the second transmission line 322 has a second slide 332, which is a movable short-circuit piece shared between the third and fourth reflection line. The first and second slide has been attached to one and the same arm 361. The arm 361 has been fastened to an axis 362 being located in the shared curvature midpoint of the first and second transmission line so that it can be rotated round the axis.

A radio frequency signal IN coming from the power amplifier of the transmitter is divided into four parts by the divider 310, the parts being a first division signal E1, a second division signal E2, a third division signal E3 and a fourth division signal E4. The first division signal E1 is led to the first port of the first hybrid 351, and it will be got out as phased from its fourth port, which is connected to the first radiator 371. Correspondingly, the second division signal E2 is led to the first port of the second hybrid 352, and it will be got out as phased from its fourth port for leading to the second radiator 372. The second port of the first hybrid 351 is connected to the first end of the first transmission line 321 by an intermediate line, and the third port is connected to the first end of the second transmission line 322 by another intermediate line. Correspondingly, the second port of the second hybrid 352 is connected to the second end of the first transmission line 321, and the third port is connected to the second end of the second transmission line 322. For the phase shift of the first E1 and second E2 division signal are then used the same two transmission lines, different ends of these lines, the short-circuits therebetween being shared. The slides 331, 332, by which those short-circuits are implemented, are side by side because of their attaching way described above. In that case the first reflection line 341, which is formed of a portion of the first transmission line 321 between its first end and the first slide 331 and of said intermediate line between the second port of the first hybrid 351 and the first end of the first transmission line, has the same length as the third reflection line 343, which is formed of a portion of the second transmission line 322 between its first end and the second slide 332 and of said intermediate line between the third port of the first hybrid 351 and the first end of the second transmission line. Owing to the same (electric) length, also the delays and phase shifts caused by the first and third reflection line are equal. This results in that the halves of the first division signal E1, reflected from the short-circuit points of the first and second transmission line, are combined as in-phase in the fourth port P4 of the first hybrid 351, and the first division signal, as a whole and with desired phase, is managed to be led to the first radiator 371. Correspondingly, the second division signal E2, as a whole and with desired phase, is managed to be led to the second radiator 372 through the fourth port of the second hybrid 352.

As mentioned, the slides of the arched transmission lines are attached to the arm 361, which is substantially perpendicular to the transmission lines. When the arm is rotated round the axis 362, the slides move simultaneously side by side, each along its own transmission line. When the slides are in the middle of the transmission lines, the phase shifts of the first E1 and second E2 division signal naturally are equal, and these signals have no phase difference in the radiators. When the arm 361 has been rotated closer to the first ends of the transmission lines, the phase shift of the first division signal has been reduced by a certain amount, and the phase shift of the second division signal has been increased by the same amount, because certain portions of the first and second transmission lines have changed from the propagation path of the first division signal to the propagation path of the second division signal. Therefore the phase of the transmitting signal of the first radiator 371 is advanced in respect to the phase of the transmitting signal of the second radiator 372, which matter has the effect that the main radiation lobe turns downwards, if the radiator row is vertical as seen from the direction of the main lobe. When the arm 361 is rotated towards the second ends of the transmission lines, the effect naturally is vice versa.

The third 353 and fourth 354 hybrid and the third 323 and fourth 324 transmission line form a similar phase shift structure for the third E3 and fourth E4 division signal as the first and second hybrid and the first and second transmission line for the first and second division signal. The third and fourth transmission line has the same curvature midpoint as the first and second transmission line, and their slides are attached to the same arm 361. The third and fourth transmission line are closer to the curvature midpoint, and thereby to the axis 362, than the first and second transmission line, for which reason they are shorter compared with the latter lines. The length difference is compensated so that the intermediate lines between the third and fourth transmission line and the third 353 and fourth 354 hybrid are correspondingly longer than the intermediate lines between the first and second transmission line and the first 351 and second 352 hybrid. More accurately, all eight lines between a middle of an arched transmission line and a port of a hybrid have the equal electrical length. That the third 323 and fourth 324 transmission line are shorter means also that the adjusting range for the third and fourth division signal is narrower than the adjusting range for the first and second division signal. This is not a drawback, because that is just how the matter has to be. The third and fourth division signal are led to the third 373 and fourth 374 radiator being located closer to the middle of the radiator row than the first and second radiator. The phase of the transmitting signals of the third and fourth radiator has to be changed less than the phase of the transmitting signals of the outermost radiators in order for the shape of the radiation lobe to remain, when the lobe is turned.

In the example of FIG. 3*a*, the arm 361 continues a little over the axis 362, as seen from the slides, so that the arm has a short second portion between the axis and the opposite end. An electric actuator 363 is connected to the outermost end of said second portion. The moving part of the actuator can be controlled to make pushing and pulling motions in the substantially transverse direction in respect of the arm direction. The rotational motion of the arm has been implemented in such a way in the example of FIG. 3*a*. The course of the end of the second portion is also arched, which matter requires a flexible moving part or a somehow elongated hole in the end of the second portion, in which hole the attaching pivot can move back and forth. A third possibility is that the whole actuator has been provided with an axis to its opposite end so that it can turn. The attaching point of the actuator moving part to the arm can alternatively be located from the axis 362 towards the slides, in which case the second portion of the arm is not needed.

Figure 4A:
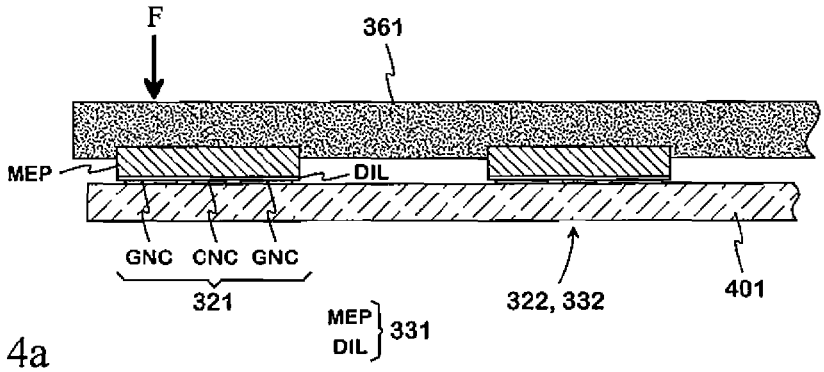
FIG. 4*a* presents an example of the slides belonging to the structure according to FIG. 3*a;*
Figure 4B:
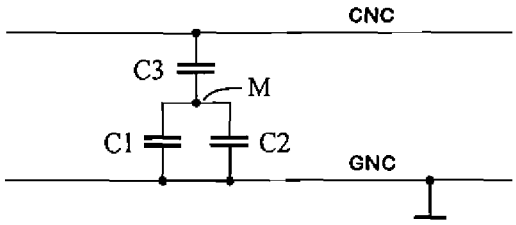
FIG. 4*b* presents an equivalent circuit of the reflection circuit implemented by a slide according to FIG. 4*a;*

FIG. 4*a* shows an exemplary section drawing about a part of the structure according to FIG. 3*a*. The section is along the arm 361 so that the transmission lines and the slides are seen as a cross section. The first 321 and second 322 transmission line and the first 331 and second 332 slide are seen in the drawing. In this example the transmission lines are formed of conductive strips on a surface of a dielectric board 401 and of that board itself. Each transmission line comprises three conductive strips; between two ground conductors GNC there is a centre conductor CNC. Thus the transmission lines have planar structure. The slides are formed of a plate-like metal piece MEP parallel with the dielectric board 401 and of a thin dielectric layer DIL covering that surface of the metal piece, which is at the side of the board 401. The slides have been attached to the recesses in the arm 361. The arm is affected by a suitable spring force F so that the first slide is pressed against the conductors of the first transmission line and the second slide against the conductors of the second transmission line. The dielectric layer DIL prevents a galvanic contact, in which case junctions of two metals and intermodulation phenomenon at the junctions are avoided. However, the centre conductor of the transmission line will be shorted to the ground through the capacitances between the metal piece MEP and the conductors of the transmission line, in the operating frequencies. FIG. 4*b* shows an equivalent circuit of the reflection circuit made by a slide, according to what is described above. A node M corresponds to the metal piece. Between the centre conductor and the node M there is a capacitor C3, and between the node and the ground conductor there are two capacitors C1 and C2 in parallel. The total capacitance is somewhat smaller than C3.

Figure 5A:
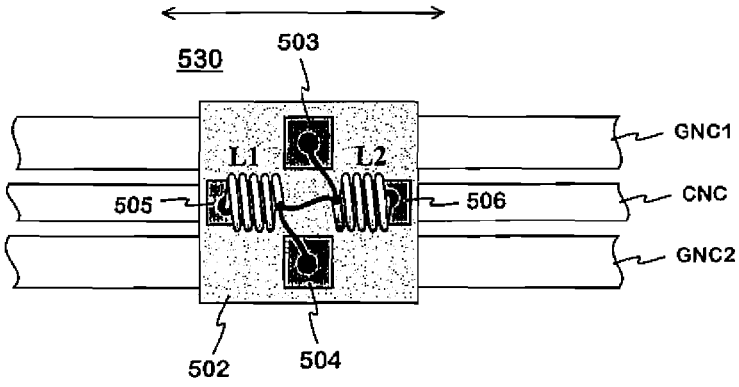
FIG. 5*a* presents another example of a reflection circuit according to the invention.

FIG. 5*a* shows another example of a reflection circuit according to the invention. Mechanically it is a slide also in this case. The slide 530 comprises a thin dielectric plate 502 having at least the same width as the whole transmission line with planar structure. The lower surface of the plate is located against the transmission line conductors. On the upper surface of the plate there is a first conductive area 503 at the first ground conductor GNC1 of the transmission line and a second conductive area 504 at the second ground conductor GNC2. In addition, on the upper surface of the plate 502 there is a third 505 and fourth 506 conductive area, both at the centre conductor CNC of the transmission line and at a certain distance from each other. The first and second conductive areas are connected to each other by a conductor wire. Between this conductor wire and the third conductive area 505 it is connected a first coil L1. Correspondingly between the conductor wire and the fourth conductive area 506 is connected a similar second coil L2. Then the structure is symmetrical so that it looks similar seen from both ends of the transmission line.

Figure 5B:
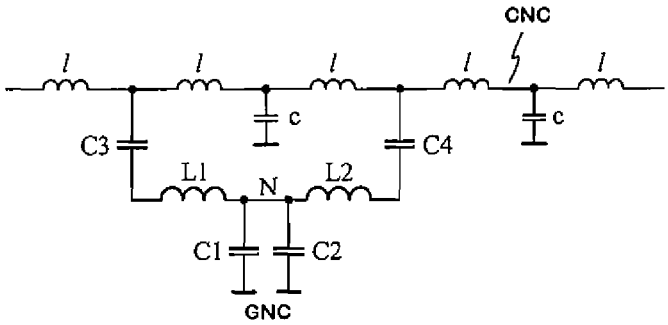
FIG. 5*b* presents an equivalent circuit of the reflection circuit according to FIG. 5*a;*

In FIG. 5*b* there is an equivalent circuit of the reflection circuit according to FIG. 5*a*. The centre conductor CNC of the transmission line is shown by small coils/connected in series so that its distributed inductance would be seen in the diagram. The distributed capacitance between the centre conductor and the ground conductors is presented by a couple of small capacitors c. The first capacitor C1 in the diagram corresponds to the capacitance between the first conductive area 503 of the reflection circuit and the first ground conductor of the transmission line, and the second capacitor C2 corresponds to the capacitance between the second conductive area 504 and the second ground conductor of the transmission line. The capacitors C1 and C2 are in parallel between the ground and a node N corresponding to the conductor wire of the reflection circuit. The third capacitor C3 in the diagram corresponds to the capacitance between the third conductive area 505 of the reflection circuit and the centre conductor of the transmission line, and the fourth capacitor C4 corresponds to the capacitance between the fourth conductive area 506 and the centre conductor. The third capacitor C3 and the first coil L1 are in series between a point of the centre conductor and the node N. Correspondingly, the fourth capacitor C4 and the second coil L2 are in series between another point of the centre conductor and the node N.

The reflection circuit above is a stop band filter by nature, when the transmission line is matched to its characteristic impedance at the line ends. The parts of the circuit are designed so that the operating band of the antenna to be fed falls into the stop band of the filter. Because of the symmetrical structure the circuit functions as a similar band stop filter for the signals leaving either end of the transmission line, reflecting these signals with equal phase shift back to their starting end. Naturally, the stop band filter can be implemented also by a different circuit as that presented in FIG. 5*a*, including inductive and capacitive elements. Compared with a short-circuiting reflection circuit, a band stop filter includes more structure parts, of course. On the other hand, however, it has the advantage that a sufficient reflection is obtained by means of smaller capacitances, which are easier to implement.

Figure 6:
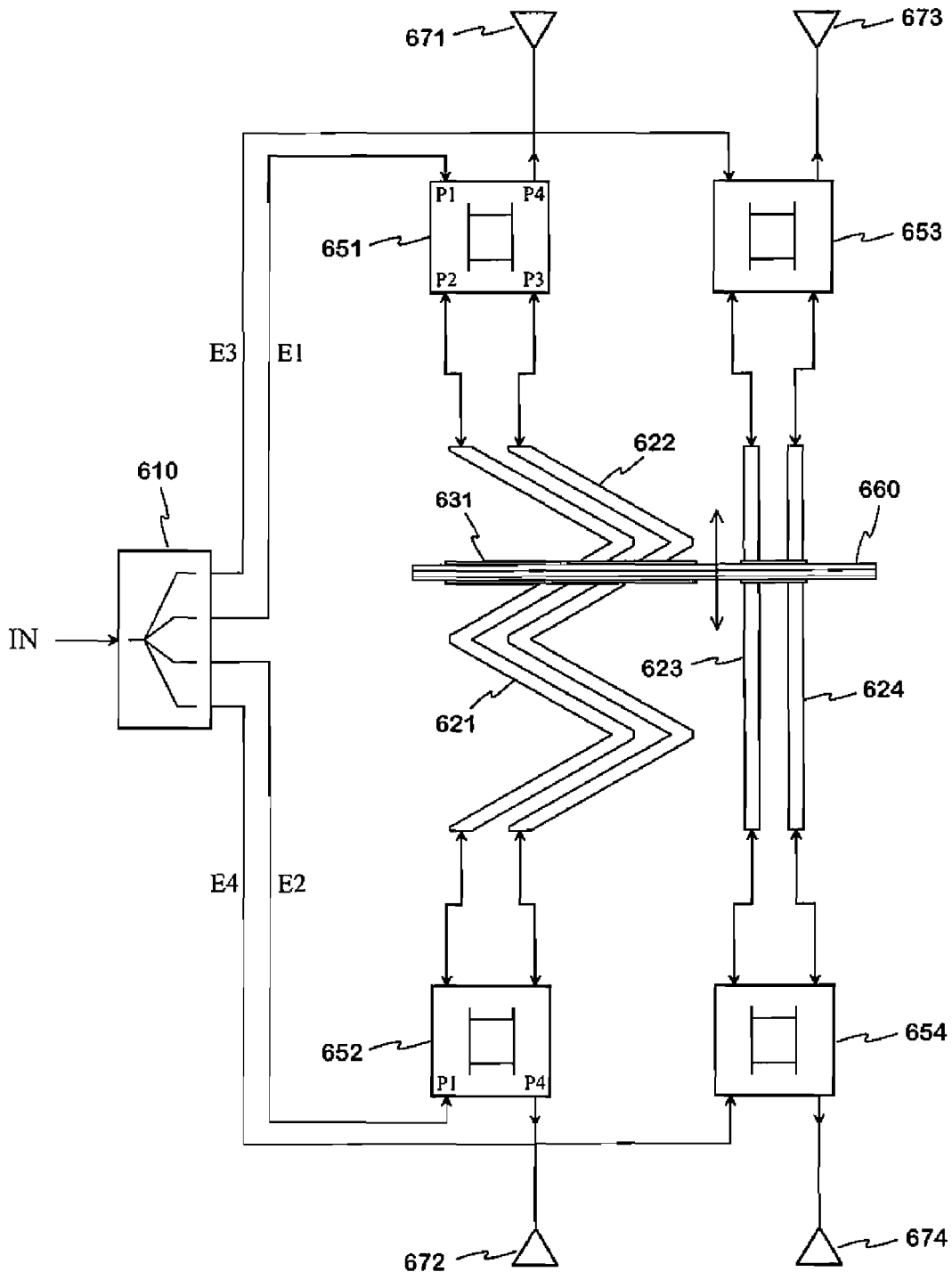
FIG. 6 presents a second example of an arrangement according to the invention, for steering the antenna radiating lobe.

FIG. 6 shows a second example of an arrangement according to the invention, for steering the radiating lobe of an array antenna. The arrangement comprises a divider 610, a first 651 and a second 652 hybrid, a first 621 and a second 622 transmission line, a third 653 and a fourth 654 hybrid, and a third 623 and a fourth 624 transmission line, connected in the same way as in the arrangement of FIG. 3*a*. So the first division signal E1 is led from the fourth port of the first hybrid to the first radiator 671. Correspondingly, the second division signal E2 is led to the second radiator 672, the third division signal E3 to the third radiator 673 and the fourth division signal E4 to the fourth radiator 674. The reflection circuits are implemented by slides, which are attached to a same movable arm 660. The difference compared with FIG. 3*a* is that the transmission lines are not arched but straight or composed of straight portions, and that the arm is moved not by rotating but by linear motions. The third and fourth transmission lines are straight at their whole length, and the arm 660 is perpendicular to them. The arm is moved in the direction of these transmission lines. The first and second transmission lines have in this example four successive straight portions, which form a zigzag pattern, and these lines are as long as the third and fourth transmission lines, measured in the moving direction of the arm. The successive portions are in this example at an angle of 30 degrees in relation to the arm direction, for which reason the first and second transmission lines have the length, which is two times the length of the third and fourth transmission lines. This results in that when the arm is moved from a place to another place, the absolute value of the change in the phase of the signals of the outer radiators 671 and 672 is two times greater than that of the signals of the inner radiators 673 and 674. In that case the radiation lobe turns remaining in its shape, if the distance of the outer radiators from the row middle is double compared with the distance of the inner radiators.

Owing to the oblique position of the portions of the first and second transmission lines, the width of their slides can not be only the same as of a transmission line, and also not separate because of the closeness of the lines. So the first and second lines have a shared slide 631, which extends in the arm direction over the total range, which is given when the first and second lines are projected to a straight line parallel to the arm. Also the third and fourth transmission lines have, in the example of FIG. 6, a shared, sufficiently wide slide.

Figure 7:
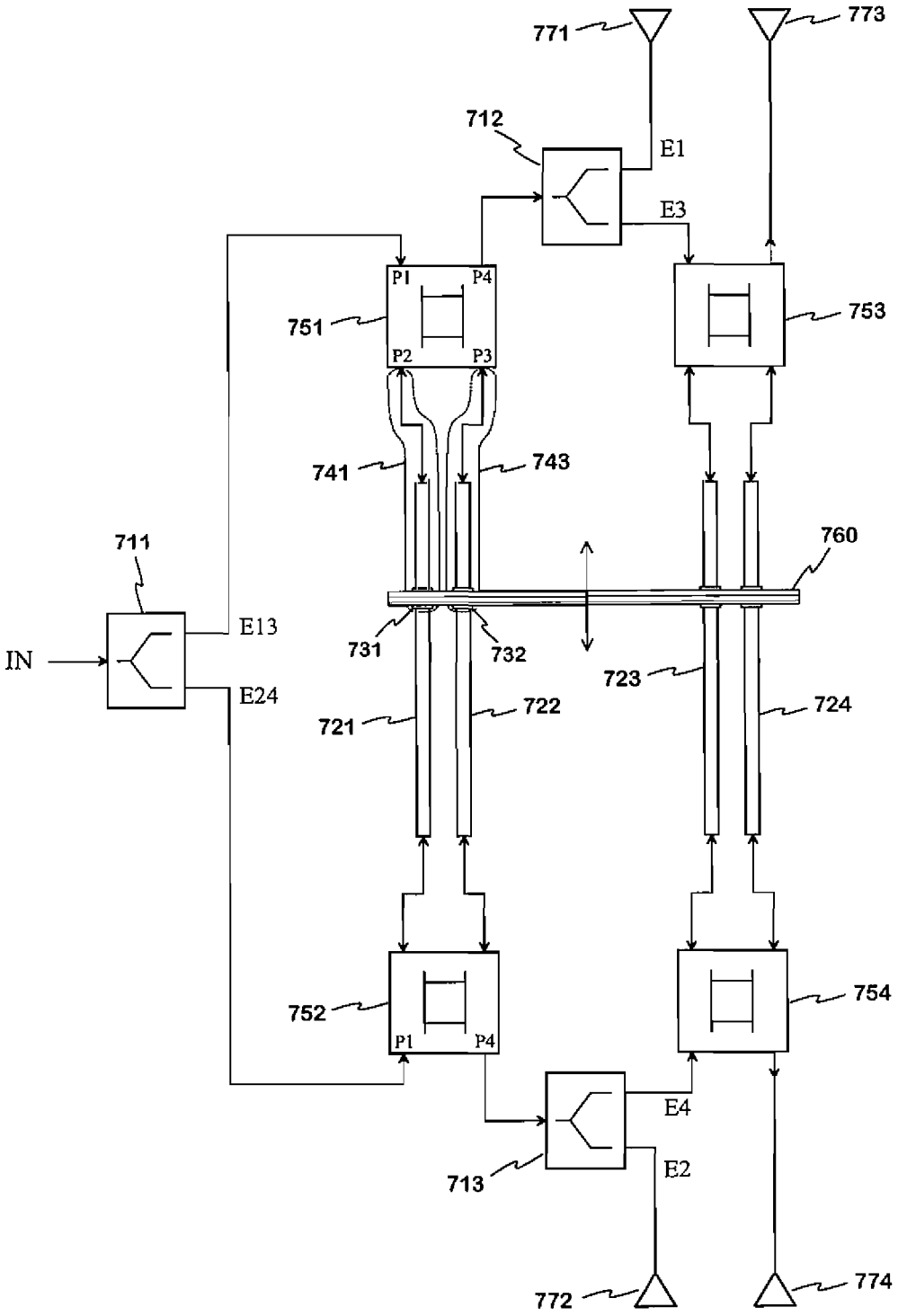
FIG. 7 presents a third example of an arrangement according to the invention for steering the antenna radiating lobe.

FIG. 7 shows a third example of an arrangement according to the invention for steering the radiating lobe of an array antenna. The array antenna comprises a first 771, second 772, third 773 and fourth 774 radiator. The first and second radiators form in this example the inner pair, and the third and fourth radiators form the outer pair. The idea is to use in the arrangement identical transmission lines, the reflection points included. The first 721, second 722, third 723 and fourth 724 transmission lines all have the same length. In addition they are straight and parallel. The arm 760 is perpendicular to the transmission lines, and it is moved by linear motions in the direction of those lines. A slide causing reflection is attached to the arm at each line.

In order to obtain different phase shifts for the signals of the radiator pairs, the phase shifters are connected in cascade: After the first phase shift a signal is divided in half, one part is led to a radiator, and to the other part is made a second phase shift, after which the other part is led to the radiator of its own. Consistent with this, the radio frequency signal IN, coming from the transmitter power amplifier, is first divided to two parts in the divider 711. The first division signal E13 is led to the first port P1 of the first hybrid 751, and it will be got out as phased from its fourth port P4. The phase shift takes place in the reflection lines 741 and 743, which include the first ends of the first and second transmission lines as far as the slides and the lines between these transmission lines and the first hybrid, in the same way as in FIGS. 3*a* and 6. The fourth port of the first hybrid is connected to a second divider 712, which divides the first division signal E13 in half to the first E1 and the third E3 antenna signal. The first antenna signal is led directly to the first radiator 771. The third antenna signal E3 in turn is led to a phase shifter formed by the third hybrid 753 and two reflection lines, which phase shifter is identical with the phase shifter delaying the division signal E13. These reflection lines comprise the first ends of the third and fourth transmission lines and their slides. The third antenna signal will then be got out from the fourth port of the third hybrid, and it is led to the third radiator 773. Compared to the phase of the first antenna signal E1, the phase of the third antenna signal is two times more lagged than the phase of the coming signal IN. Correspondingly, the second division signal E24 is led to the first port P1 of the second hybrid 752, and it will be got out as phased from its fourth port P4. The phase shift takes place in the reflection lines, which include the second ends of the first and second transmission lines as far as the slides and the lines between these transmission lines and the second hybrid, in the same way as in FIGS. 3*a* and 6. The fourth port of the second hybrid is connected to a third divider 713, which divides the second division signal E24 in half to the second E2 and the fourth E4 antenna signal. The second antenna signal is led directly to the second radiator 772. The fourth antenna signal E4 in turn is led to a phase shifter formed by the fourth hybrid 754 and two reflection lines, which phase shifter is identical with the phase shifter delaying the division signal E24. These reflection lines comprise the second ends of the third and fourth transmission lines and their slides. The fourth antenna signal will then be got out from the fourth port of the fourth hybrid, and it is led to the fourth radiator 774. Compared to the phase of the second antenna signal E2, the phase of the fourth antenna signal is two times more lagged than the phase of the coming signal IN.

FIG. 8 shows a fourth example of an arrangement according to the invention for steering the radiating lobe of an array antenna. From the point of view of the signals to be fed to the radiators, the arrangement is similar to the arrangements presented in FIGS. 3*a* and 6. The difference is that, instead of one movable reflection circuit, each transmission line has now several, in this example seven, fixed reflection circuits. Each reflection circuit comprises a switch by which it can be activated, or to set reflective. A reflection circuit being inactivated is transparent, or it has no significant effect on the signal propagating in the transmission line. One reflection circuit from the reflection circuits of a line is activated at a time. Changing the activated reflection circuit corresponds to moving the mechanical arm in FIGS. 3*a* and 6. The activating of reflection circuits is implemented by the controller 860, which can be e.g. a decoder. The number of controller outputs is the same as the number of reflection circuits of a line. Each controller output is connected to one reflection circuit of each line.

The first 821 and second 822 transmission lines are for the outer radiator pair 871, 872, and the third 823 and fourth 824 transmission lines are for the inner radiator pair 873, 874. All transmission lines are equally long. The middle reflection circuit of each transmission line is at the halfway point of the transmission line. The other reflection circuits are on both sides of the middle circuit, with regular distances in this example. For the phase shifts of the signals of the inner radiators to be smaller than of the signals of the outer radiators, the reflection circuits of the third and fourth transmission lines are closer to each other than the reflection circuits of the first and second transmission lines. When the middle reflection circuits are activated, the signals of all radiators have the same phase. In the example of the drawing the second output S2 of the decoder 860 is set to the active state. The second output is connected to the second reflection circuits in order, as viewed from the first and third radiators. These second reflection circuits, or the reflection circuit 831 of the first transmission line, the reflection circuit 832 of the second transmission line, the reflection circuit 833 of the third transmission line and the reflection circuit 834 of the fourth transmission line, thus reflect the signals arriving to it from both sides. Therefore the phase of the transmitting signal of the first radiator 871 is advanced in respect of the phase of the transmitting signal of the second radiator 872, and the phase of the transmitting signal of the third radiator 873 is advanced in respect of the phase of the transmitting signal of the fourth radiator 874, which matter has the effect that the main radiation lobe turns downwards.

Figure 9:
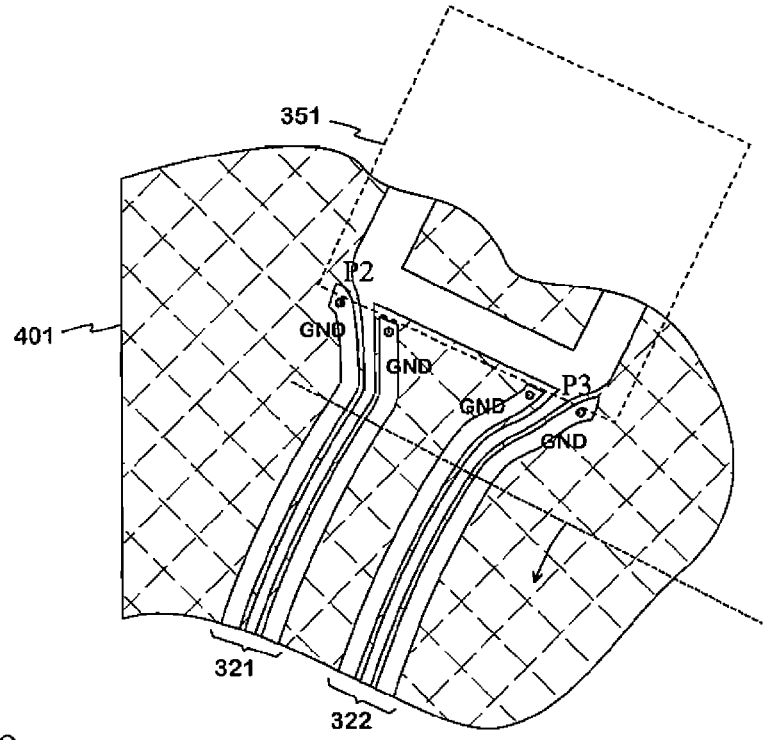
FIG. 9 presents an example how the transmission lines and the hybrid are connected to each other in the structure according to the invention.

FIG. 9 shows an example of how the transmission lines and a hybrid are connected to each other in the structure according to invention. Same reference numbers have been used in this figure as in FIGS. 3*a* and 4. A part of the dielectric plane 401 is seen from above. On the upper surface of the plane there are the first 321 and second 322 arched transmission lines with their conductors. The moving range of the slides of the transmission lines has a limit, which is marked with a dashed line to the figure. The first hybrid 351 is formed of a conductor pattern on the upper surface of the plane 401 and of the signal ground (not visible) having an extent of the whole hybrid on the lower surface of the plane. The intermediate lines, which connect the second P2 and third P3 port of the hybrid to the transmission lines 321, 322, are unitary continuations of these transmission lines on the upper surface of the plane 401. The ground conductors of the intermediate lines are connected by through holes to the ground on the lower surface of the plane, on the side of the hybrid. The intermediate lines are almost equally long.

Figure 10:
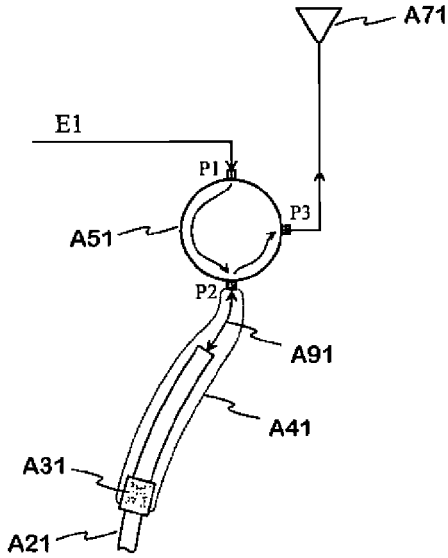
FIG. 10 presents an example of a phase shifter with one reflection line.

FIG. 10 shows an example of a phase shifter with one reflection line. The reflection line A41 consists of the portion of a transmission line A21 between its one end and a reflection circuit A31 and of a line A91 between the transmission line A21 and a separating element A51. The separating element is in this example a circulator with three ports. One signal E1 to be transmitted is fed to the first port P1. It gets out from the second port P2, but not from the third port P3. The second port is connected to the reflection line A41. The signal coming back to the second port from that line goes on back to the circulator, where it gets out from the third port, but not from the first port. The third port P3 is connected to a radiator A71.

Above is described an arrangement for steering the radiation lobe of an array antenna, the arrangement being based on the reflection-type phase shifters and differential phase shift regarding a radiator pair. The described structure can differ from what is presented in details. The number of the antenna radiators can naturally vary. The number can also be odd, in which case the phase of the transmitting signal of the middle radiator is not adjustable. The transmission lines can be implemented in different ways, e.g. their conductors can be relatively rigid and air-insulated. Both in an air-insulated structure and in a structure using a circuit board the conductors, which are separated from the ground, of the transmission lines, hybrids and dividers can be unitary strips without junctions. Correspondingly, some ground conductors can form a unitary strip with each other. Also the implementing way of the slides can vary; their conductive part can e.g. be just an extension of a conductive arm. The inventive idea can be applied in different ways within the limits defined by the independent claim 1.

The invention claimed is:

1. An arrangement for steering a radiation lobe of an array antenna comprising:

at least one radiator row, which row has at least two radiator pairs, phases of the signals of the radiators in each pair being arranged to change to opposite directions, when the antenna is adjusted by means of said arrangement, which arrangement comprises a divider to divide a transmitting signal into division signals to be led to different radiators and for each radiator pair:

a first reflection-type phase shifter comprising a first hybrid with a first, second, third and fourth port, a first division signal of the pair being split into halves on the path from the first port to the second and third port of the first hybrid, a first reflection line with adjustable length connected to the second port of the first hybrid to delay a half of the first division signal of the pair, a third reflection line with adjustable length connected to the third port of the first hybrid to delay another half of the first division signal of the pair, the delayed halves of said first division signal, returned from the first and third reflection lines, being again combined into the fourth port of the first hybrid, a second reflection-type phase shifter comprising a second hybrid with a first, second, third, and fourth port, a second division signal of the pair being split into halves on the path from the first port to the second and third port of the second hybrid, a second reflection line with adjustable length connected to the second port of the second hybrid to delay a half of the second division signal of the pair, a fourth reflection line with adjustable length connected to the third port of the second hybrid to delay another half of the second division signal of the pair, the delayed halves of said second division signal, returned from the second and fourth reflection lines, being again combined into the fourth port of the second hybrid, wherein for each radiator pair, said first and second reflection lines form a unitary first transmission line, one end of which is connected to the second port of the first hybrid and the other end of which is connected to the second port of the second hybrid, said third and fourth reflection lines form a unitary second transmission line, one end of which is connected to the third port of the first hybrid and the other end of which is connected to the third port of the second hybrid, the first transmission line comprises a first slide as a reflection circuit shared between the first and second reflection lines, to form a first reflection point, in which case the first reflection line extends from the first reflection slide to the second port of the first hybrid, and the second reflection line extends from the first slide to the second port of the second hybrid, and the second transmission line comprises a second slide as a reflection circuit, shared between the third and fourth reflection lines, to form a second reflection point, in which case the third reflection line extends from the second slide to the third port of the first hybrid, and the fourth reflection line extends from the second slide to the third port of the second hybrid, and the arrangement further comprises a movable arm to which each slide is attached to move the first and second reflection points and thus to change the lengths of said reflection lines by a distance which is proportional to the positions of the radiators of the pair at issue in the row.

2. An arrangement according to claim 1, wherein the number of the reflection circuits on each transmission line is at least two, and these reflection circuits are fixed and each of them comprises a switch by which it can be set transparent or reflective, wherein said means to move the reflection points comprise an electric controller, the number of controller outputs being the same as the number of reflection circuits of each line, and each output is connected to one reflection circuit of each line to set one reflection circuit of each line to reflective state at a time.

3. An arrangement according to claim 1, wherein each transmission line is arched, and has a shared curvature midpoint, and said arm is fastened to an axis being located in this midpoint, to move said slides by rotating motion of the arm, wherein the transmission lines corresponding to an outer radiator pair in the row are located farther from the curvature midpoint than the transmission lines corresponding to an inner radiator pair in the row, to proportion the phase shifts to the positions of the radiators in the row.

4. An arrangement according to claim 3, wherein the means to move the reflection points further comprise an electric actuator, a moving part of which is attached to the arm and is arranged to make pushing and pulling motions in a substantially transverse direction in respect of the arm direction, to implement said rotating motion.

5. An arrangement according to claim 1, wherein each transmission line is substantially composed only of straight portions, the number of which is at least one, and said arm is arranged to be moved by a linear motion perpendicular to the arm direction, and the transmission lines corresponding to an outer radiator pair in the row are substantially as long as the transmission lines corresponding to an inner radiator pair in the row as measured in the motion direction of the arm, but longer than the latter transmission lines as measured along the transmission lines, to proportion the phase shifts to the positions of the radiators in the row.

6. An arrangement according to claim 5, wherein the transmission lines corresponding to an inner radiator pair in the row are straight at their whole length, and the transmission lines corresponding to an outer radiator pair in the row comprise straight portions, which form a zigzag pattern.

7. An arrangement according to claim 6, wherein the reflection circuits of the transmission lines corresponding to the outer radiator pair in the row are implemented by a shared slide, which extends in the arm direction over the total range, which is given when both of these transmission lines are projected to a straight line parallel to the arm.

8. An arrangement according to claim 1, said transmission lines having planar structure so that they comprise a strip-like centre conductor and on both sides of it a strip-like ground conductor.

9. An arrangement according to claim 8, said centre conductor and ground conductors being microstrips on a surface of a dielectric plane.

10. An arrangement according to claim 8, said transmission lines being air-insulated.

11. An arrangement according to claim 1, said slides comprising a plate-like metal piece and its dielectric coating on the side, which is configured to be located against said transmission lines.

12. An arrangement according to claim 1, each of said slides comprising a dielectric plate configured to be pressed against a transmission line and on this plate inductive and capacitive elements such that the reflection circuit operates as a band stop filter, the stop band of which filter covers the operation band of the antenna to be fed.

13. An arrangement for steering a radiation lobe of an array antenna comprising:

at least one radiator row, which row comprises at least two radiator pairs, phases of the signals of the radiators in each pair being arranged to change to opposite directions, when the antenna is adjusted by means of said arrangement, which arrangement comprises a divider to split a transmitting signal into division signals to be led to different radiators, and for each radiator pair:

a first reflection-type phase shifter comprising a first hybrid with a first, second, third and fourth port, a first division signal of the pair being split into halves on the path from the first port to the second and third port of the first hybrid, a first reflection line with adjustable length connected to the second port of the first hybrid to delay a half of the first division signal of the pair, a third reflection line with adjustable length connected to the third port of the first hybrid to delay another half of the first division signal of the pair, the delayed halves of said first division signal, returned from the first and third reflection lines, being again combined into the fourth port of the first hybrid, a second reflection-type phase shifter comprising a second hybrid with a first, second, third and fourth port, a second division signal of the pair being split into halves on the path from the first port to the second and third port of the second hybrid, a second reflection line with adjustable length connected to the second port of the second hybrid to delay a half of the second division signal of the pair, a fourth reflection line with adjustable length connected to the third port of the second hybrid to delay another half of the second division signal of the pair, the delayed halves of said second division signal, returned from the second and fourth reflection lines, being again combined into the fourth port of the second hybrid, wherein for each radiator pair, said first and second reflection lines form a unitary first transmission line, one end of which is connected to the second port of the first hybrid and the other end of which is connected to the second port of the second hybrid, said third and fourth reflection lines form a unitary second transmission line, one end of which is connected to the third port of the first hybrid and the other end of which is connected to the third port of the second hybrid, the first transmission line comprises at least two fixed reflection circuits shared between the first and second reflection lines, each reflection circuit comprising a switch by which it can be set transparent or reflective, to form a first reflection point, in which case the first reflection line extends from the first reflection point to the second port of the first hybrid, and the second reflection line extends from the first reflection point to opposite direction to the second port of the second hybrid, and the second transmission line comprises at least two fixed reflection circuits shared between the third and fourth reflection lines, each reflection circuit comprising a switch by which it can be set transparent or reflective, to form a second reflection point, in which case the third reflection line extends from the second reflection point to the third port of the first hybrid, and the fourth reflection line extends from the second reflection point to opposite direction to the third port of the second hybrid, and the arrangement further comprises a common electric controller for the two radiator pairs, the number of controller outputs being the same as the number of reflection circuits of each transmission line, and each output is connected to one reflection circuit of each transmission line to set one reflection circuit of each line to a reflective state at a time, to change the lengths of said reflection lines by distance, which is proportional to the positions of the radiators of the pair at issue in the row.

* * * * *